US007404835B2

(12) United States Patent
Kramer

(10) Patent No.: US 7,404,835 B2
(45) Date of Patent: Jul. 29, 2008

(54) COLLECTION DEVICE WITH SELF SEALING RETENTION SYSTEM

(75) Inventor: Michael Kramer, Springdale, AR (US)

(73) Assignee: Alto U.S. Inc., Springdale, AR (US)

( * ) Notice: Subject to any disclaimer, the term of this patent is extended or adjusted under 35 U.S.C. 154(b) by 268 days.

(21) Appl. No.: 10/905,523

(22) Filed: Jan. 7, 2005

(65) Prior Publication Data

US 2006/0150590 A1 Jul. 13, 2006

(51) Int. Cl.
*A47L 9/14* (2006.01)

(52) U.S. Cl. ..... 55/372; 55/373; 55/376; 55/378; 55/DIG. 2; 55/467; 55/381; 15/347; 15/352

(58) Field of Classification Search ..... 55/372, 55/373, 376, 378, DIG. 2, 467, 381; 15/347, 15/352

See application file for complete search history.

(56) References Cited

U.S. PATENT DOCUMENTS

| | | | | | |
|---|---|---|---|---|---|
| 1,871,024 | A | * | 8/1932 | Barber | 55/371 |
| 2,008,431 | A | | 7/1935 | Altken | |
| 2,143,970 | A | | 1/1939 | Blood | |
| 2,252,160 | A | | 8/1941 | Blood | |
| 2,945,558 | A | | 7/1960 | Cordell | |
| 3,755,993 | A | * | 9/1973 | Cote | 55/370 |
| 3,938,283 | A | | 2/1976 | Keith, Jr. | |
| 4,072,483 | A | * | 2/1978 | Doyle, Jr. | 55/372 |
| 4,185,976 | A | * | 1/1980 | Kosik et al. | 55/373 |
| 4,601,735 | A | | 7/1986 | Morton, Jr. | |
| 4,678,486 | A | * | 7/1987 | Jacob et al. | 55/374 |
| 4,765,099 | A | | 8/1988 | Tanner | |
| 4,800,614 | A | | 1/1989 | Kopco et al. | |
| 4,870,714 | A | | 10/1989 | Miner | |
| 4,959,045 | A | * | 9/1990 | Hartley et al. | 493/254 |
| 5,551,122 | A | | 9/1996 | Burkhardt et al. | |
| 5,581,842 | A | | 12/1996 | Seith | |
| 6,178,590 | B1 | * | 1/2001 | Lindsay et al. | 15/327.1 |
| 6,210,457 | B1 | * | 4/2001 | Siemers | 55/429 |
| 6,224,471 | B1 | | 5/2001 | Clowers et al. | |
| 6,618,898 | B2 | | 9/2003 | Tingle | |
| 6,758,731 | B2 | | 7/2004 | Dutterer et al. | |

* cited by examiner

*Primary Examiner*—Duane Smith
*Assistant Examiner*—Minh-Chau T. Pham
(74) *Attorney, Agent, or Firm*—Blackwell Sanders LLP

(57) ABSTRACT

A debris collection device with a self cleaning retention system that is designed for powered tools such as a sander. One embodiment of the system has an inflatable collection bag and a bag retention system, which further includes an integral bag adapter nozzle for retaining the collection bag to the debris exhaust of a tool such as a sander. For one embodiment of the debris collection device, the retention system can also has a tube, pipe or bracket which connects the adapter to powered tool such as a sander.

10 Claims, 6 Drawing Sheets

COLLECTION DEVICE WITH SELF SEALING RETENTION SYSTEM

BACKGROUND OF INVENTION

1. Field of Invention

This invention relates generally to debris collection devices for hand held power tools and, more particularly, to detachable dust collection bags for sander machines and the like.

2. Background Art

There are various debris collection devices for powered tools or appliances that exhaust intake and exhaust debris as part of its operation. For example a vacuum cleaner vacuums up dust and particles and debris and coveys them along a vacuum channel or hose with exhaust and/or supplemental air to a collection device attached to the exhaust end of the vacuum channel or hose. The collection device can be a cloth bag attached to the exhaust end of the vacuum channel or hose. The cloth bag can have an opening sufficiently size to fit of the exhaust opening of vacuum channel. A string, band, clamp or other like component or external securing device can be cinched about the cloth around the bag opening to fix the bag opening to the exhaust end of the vacuum channel. This dust bag retention method requires the external securing device such as a band, which can be time consuming to remove and install when removing and installing the collection bag.

Similarly, for example, powered sanding apparatuses have been known and used in the sanding or grinding operation to provide a substantially smooth surface to a material or for removing finishes from such material. These types of sanding devices have the problem of controlling or collecting the wood dust or other particulate matter generated due to the sanding or grinding operation. Controlling and containment of dust and particulate materials generated during a sanding operation are often desirable for safety and reducing clean up. A plurality of devices have been used made for controlling and containing the debris from the wood sander. One type of collection device for a sander is a cloth bag having an opening for placing over the exhaust of the sander. However the same method and problems associated therewith exists for retention of the bag to an exhaust channel.

One type of securing device is a draw string that is hemmed into the attachment end of the dust bag about the opening that fits over the exhaust nozzle of the sander. For example, the opening is sufficiently sized to fit over a flare opening in the dust extraction conduit (channel/nozzle). The string is cinched and tied to the conduit. Retention is achieved against a flare. Also, it is typical that the entire external securing device is wholly separate from the collection bag, such as a clamp, band or clip, thus the securing device may be more prone to damage or getting lost. The retention method also tends to allow debris to be released around the opening. Debris also has the tendency to rest within the folds around the opening of the dust bag where it is cinched or gathered around and retained on the exhaust channel, which will allow wood dust to be released into the atmosphere when the securing device is removed.

A better bag design and retention apparatus is needed for retaining such bags to an exhaust channel because current methods for attaching and detaching collection bags to and from sanding machines require external securing devices. The act of attaching and detaching these securing devices such as bands and draw strings requires unnecessary time and effort and often debris escapes from the cinched portion of the bag when the securing device is detached.

BRIEF SUMMARY OF INVENTION

The invention is debris collection device with a self cleaning retention system. One embodiment of the system comprises an inflatable collection bag and a bag retention system, which further comprises an integral bag adapter nozzle for retaining the collection bag to the debris exhaust of a tool such as a sander. For one embodiment of the debris collection device, the retention system can also comprise a tube, pipe or bracket which connects the adapter to powered tool such as a sander.

The present invention is debris collection device with a self sealing retention system that may comprises a tube, pipe, or bracket, and further comprises a collection bag and an integral bag adapter. The optional extension tube, pipe or bracket, may be cast or formed from metal or plastic tubing or piping or other appropriate material. A groove or recessed ring, of appropriate size and location is formed in the exhaust end of the tube. If an extension tube is not used then the groove can be formed in the exhaust nozzle or conduit of the sander. Although the extension tube is not necessary, the tube allows the bag to be positioned the appropriate proximate distance away from the sander such that the bag does not restrict the user's handling an maneuvering of the powered tool. The tube can also be designed such that the end of the tube that mounts to the sander's exhaust conduit can rotate about its cylindrical axis with respect to the conduit. This allows the user some range in repositioning the bag.

The collection bag can be made of a filtering cloth or other suitable filtering media. The collection bag can be designed with a zippered opening for dispensing of any debris that has been collected in the bag. The collection bag has an appropriate sized opening with a cloth tubing or sleeve attached to and extending from the opening thereby creating a communicable channel from the opening through the cloth tubing. The cloth tubing or sleeve has sufficient diameter to fit over an adapter, but not excessively oversized, which would cause cinching, but sized to easily to fit over an adapter and the sleeve is fixed to the adapter by a clamp, glue, band or other securing device that will secure the bag to the adapter preferably in a substantially permanent fashion.

One embodiment of a bag adapter can be molded from a vinyl elastomer, but may be made from various other appropriate resilient materials having the appropriate elasticity. The adapter is preferably substantially cylindrical in form and the exterior of the adapter preferably has protrusions for assisting in securing and removing the adapter from the extension tube or exhaust conduit. The bag adapter has an internal feature in the form of a bead or projecting ring of appropriate size and location for mating with the recessed ring of the extension tube or the exhaust conduit. The bead is designed to mate into the groove or recessed ring formed in the tube or exhaust conduit.

When the adapter is press fit on the end of the tube, the bead expands due to the elasticity of the adapter to fit over the tube or the exhaust tubing, and when the bead reaches the groove it contracts and it abruptly drops into the groove, thereby signaling to the user that the adapter and bag are secured. The mating of the bead and the groove provides a seal and retention without need for a detent or moving parts whose function can be impeded by wood dust.

The present invention with retention system integrated with the collection bag increases productivity by eliminating a time consuming task of attaching and detaching an external securing device. The present invention also reducing down time and cost by eliminating extra removable loose parts such as bands, clamps and clips. The present invention reduces the amount of airborne dust resulting detaching the bag because the cinches caused by a draw string has been eliminated.

These and other advantageous features of the present invention will be in part apparent and in part pointed out herein below.

BRIEF DESCRIPTION OF THE DRAWINGS

For a better understanding of the present invention, reference may be made to the accompanying drawings in which.

DETAILED DESCRIPTION OF INVENTION

Figure 1:
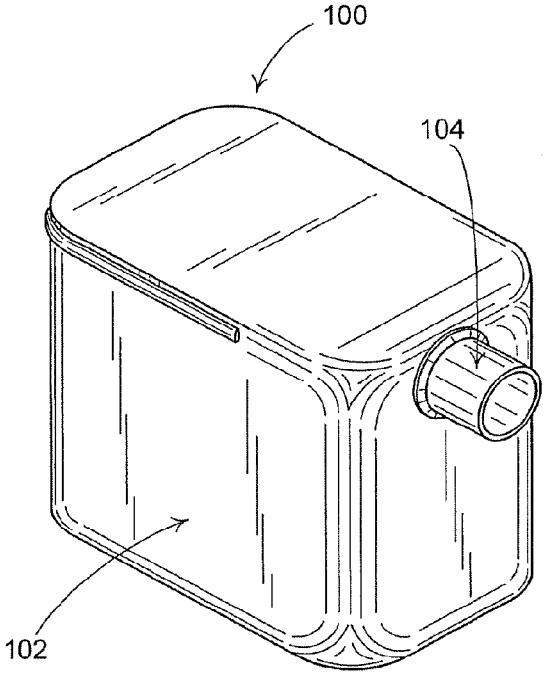
FIG. 1 is a right-side, top and front perspective view of a collection bag device with a self sealing retention system adapter.

According to the embodiment(s) of the present invention, various views are illustrated in FIGS. 1-15 and like reference numerals are being used consistently throughout to refer to like and corresponding parts of the invention for all of the various views and figures of the drawing. Also, please note that the first digit(s) of the reference number for a given item or part of the invention should correspond to the Fig. number in which the item or part is first identified.

One embodiment of the present invention comprising a self sealing retention system that may comprises a tube, pipe, or bracket, and further comprises a collection bag and an integral bag adapter teaches a novel apparatus for debris collection bag, specifically a collection bag for a sander.

Figure 15:
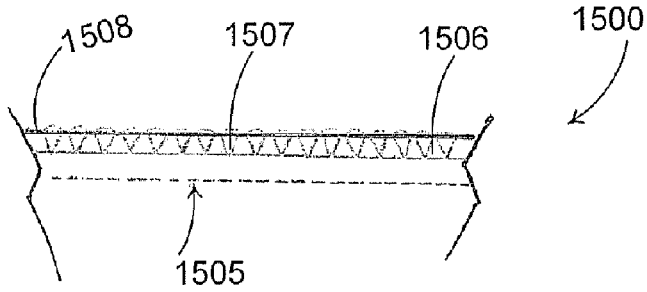
FIG. 15 is representative a safety stitch for seams of a collection bag.

The details of the invention and various embodiments can be better understood by referring to the figures of the drawing. Referring to FIG. 1, a right-side, top and front perspective view of a collection bag device 100 with a self sealing retention system adapter is shown. The collection bag device 100 comprises two major components and they are the collection bag 102 and the integral adapter 104. The bag 102 is preferably made up of a canvas/cloth material that has filtering characteristics. The bag 102 must be capable of retaining particles such as dust and sawdust without allowing the particles to escape into the atmosphere. The adapter 104 is an integral part of the collection device such that the adapter provides a communicable channel from the interior of the bag to the exterior of the bag. This adapter establishes such a communicable channel such that debris can be channeled into the interior of the bag from the exhaust of a powered tool. The adapter 104 is fixed to the bag 102 in a substantially permanent manner in order to alleviate the problem of keeping track of multiple parts. The bag portion 102 of the device can be constructed of multiple cloth panels that are sown together with a safety stitching as shown in FIG. 15.

Figure 2:
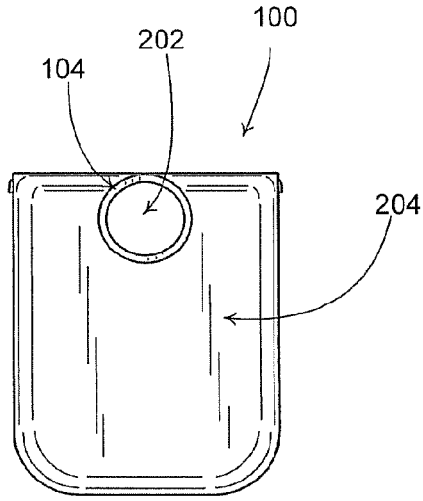
FIG. 2 is a front plan view of the collection bag device.

Referring to FIG. 2, a front plan view of the collection bag device is shown. The front view of the collection bag device reveals the channel 202 created by the adapter 104 and is communicable between the interior of the bag and the exterior of the bag. The front panel 204 of the collection bag device can be a separate cloth panel sown together along its perimeter or with surrounding panels. Alternatively, front panel 204 could be a portion of a single continuous piece of cloth that also makes up another panel such as the bottom panel.

Figure 3:
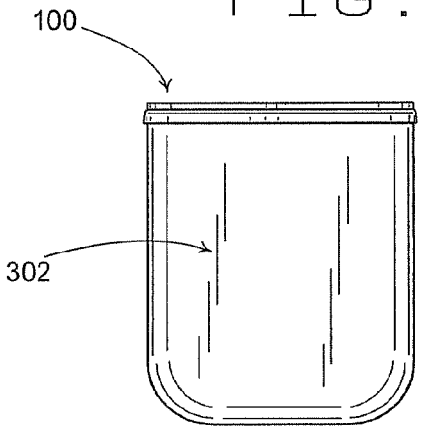
FIG. 3 is a rear plan view of the collection bag device

Referring to FIG. 3, a rear plan view of the collection bag device is shown. The review of the collection bag device reveals the rear panel 302, which can be an individual panel sown around its perimeter connecting it to surrounding panels or rear panel 302 can be a portion of a single continuous cloth that make up one or more of the other panels, for example the left and right side panels.

Figure 4:
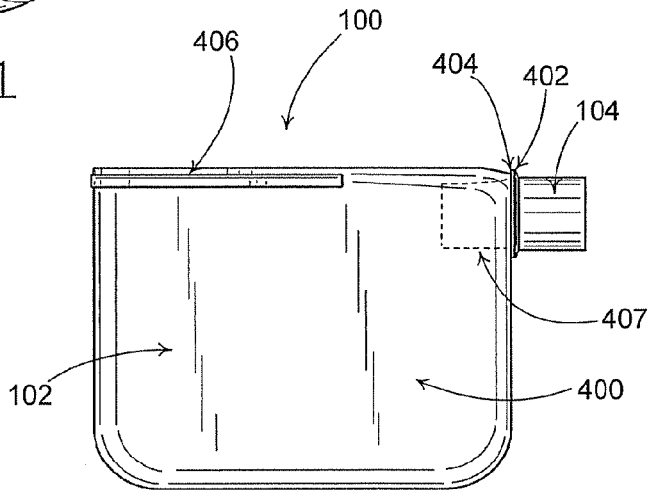
FIG. 4 is a right-side plan view.

Referring to FIG. 4, a right-side plan view of the collection bag device is shown. The right-side view of the collection bag device reveals the side panel 400 which can be a single individual panel sown around its perimeter connecting it to the surrounding panels or side panel 400 can be a portion of a single continuous piece of cloth that makes up one or more of the other panels, for example the rear and left side panels. The side view also reveals a re-closeable zippered opening 406, which allows for an opening in the collection bag to be created for exposing the interior portion of the bag. This opening allows for the user to empty debris collected in the interior portion of the bag. The side view also reveals how the adapter 104 is inserted through an opening 404, which can be referred to as the small debris entry opening of the bag and through a sleeving 407 communicably connected to the opening 404 such that the rear portion of the adapter can be asserted therethrough creating a communicable channel from the interior portion of the bag to the exterior portion of the bag. The sleeving 407 can be sized to fit about the exterior of the adapter 104 such that the adapter can be inserted therethrough, where the sleeving can preferable have a tubular construction with openings on opposing ends. The sleeving 407 can be sewn to the opening connecting the mouth of the sleeve along the edges of the opening. The adapter 104 can also include a protrusion 402 or multiple protrusions about its exterior to assist the user in installing the collection bag device onto the exhaust conduit of a powered tool and to further assist removing therefrom. The adapter 104 can be secured to the sleeve 407 thereby substantially securing the adapter 104 to the collection bag 100.

Figure 5:
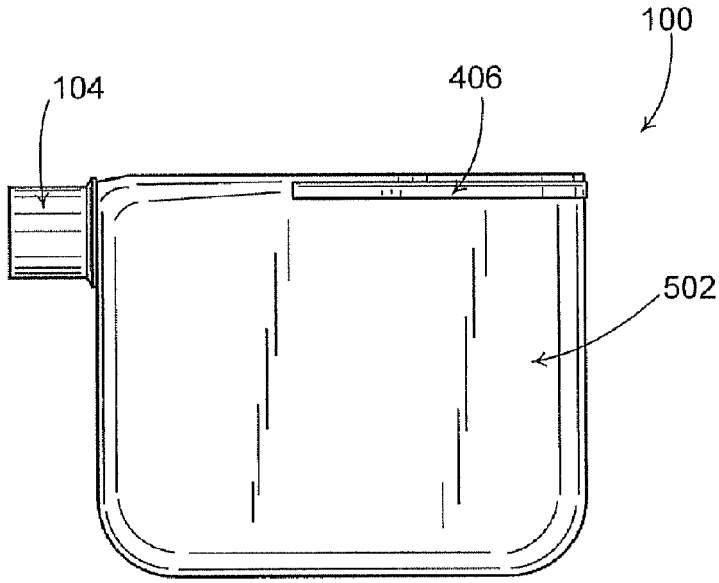
FIG. 5 is a left-side plan view.

Referring to FIG. 5, a left-side plan view of the collection bag device is shown. The left-side view reveals the opposing side of the zipper 406 which provides a continuous zippered opening from the right side about the rear and continuing one to the left side as shown. The zippered opening does not have to be this length but could be longer or shorter depending on the type of debris that has to be removed from the interior portion of the collection bag. The left-side view of the collection bag device 100 also reveals the left side panel 502 which can be a single panel that is sown about its perimeter to the adjacent panels or the left side panel can be a portion of a single continuous piece of cloth that makes up one or more of the other panels, for example the rear and right side panels.

Figure 6:
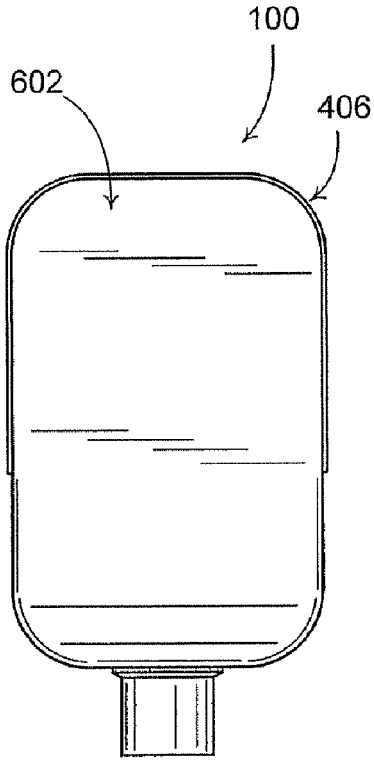
FIG. 6 is a top plan view.

Referring to FIG. 6, a top plan view of the collection bag is shown. The top view of the collection bag device 100 reveals the top panel 602 which can be allowed to flap upward and away from the adjacent panels creating an opening when the zippered opening is unzipped. This embodiment has the zippered opening 406 positioned about the rear portion of the top panel 602. Therefore, when unzipped, the rear portion of the top panel is allowed to flap away from the adjacent panels creating an opening to the interior portion of the bag thereby allowing debris to be removed therefrom. The top panel 602 can be an individual separate panel or can be a portion of one continuous piece of cloth that makes up one or more other panels.

Figure 7:
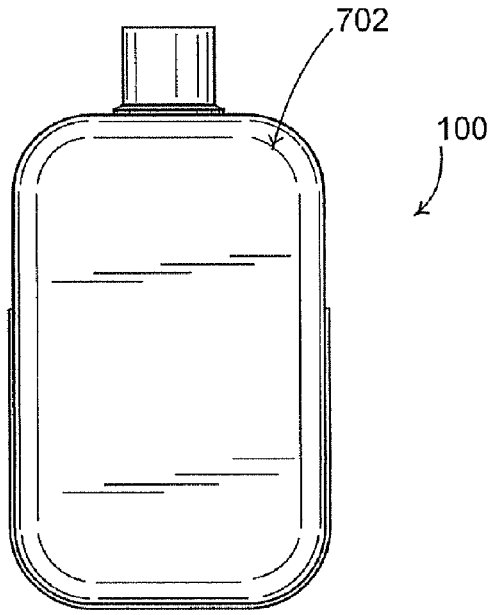
FIG. 7 is a bottom plan view.

Referring to FIG. 7, a bottom plan view of the collection bag device is shown. The bottom view reveals the bottom panel 702 of the collection bag device 100. The bottom panel 702 can be an individual separate panel or can be a portion of a single continuous piece of cloth with makes up one or more other panels, for example the rear panel.

Figure 8:
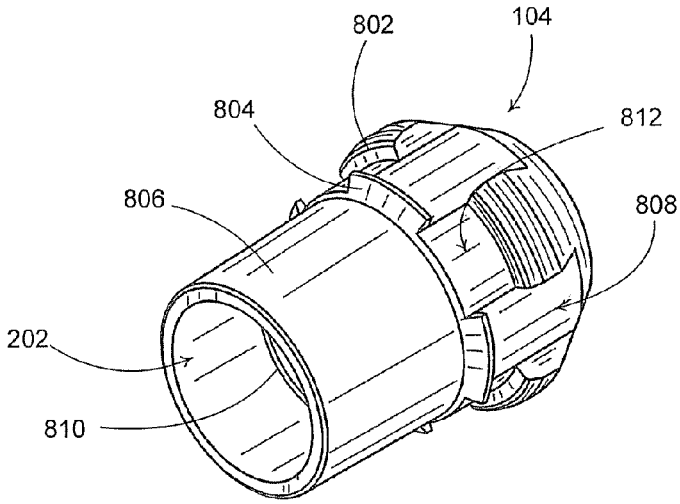
FIG. 8 is a perspective view of the adapter.

Referring to FIG. 8, a perspective view of the adapter is shown. The perspective view of the adapter 104 reveals the various features of the adapter. The adapter 104 includes a rear portion 808 and a front portion 806. The rear/aft portion 808 is inserted through the opening of the hole of the collection bag and through the sleeve portion of the collection bag. The front portion 808 of the adapter 104 is positioned exterior the bag. It is the front portion of the adapter that mounts to the exhaust conduit of the powered tool. The adapter is preferably a tubular resilient elastomeric adapter having an interior hollow that is substantially cylindrical. The adapter 104 also includes various rear/aft protruding 802 and front protruding 804 members that readily extend outward from the exterior of the adapter. The protrusions 802 and 804 serve multiple purposes including creating a recessed region 812 for mounting the adapter to the bag as well as serving a purpose of assisting the user when removing and installing the collection device on the exhaust conduit of the powered tool. The raised protruding portions 802 and 804 provide a gripping means for the user in order to press fit the adapter over the powered tool exhaust conduit and removing it therefrom. The perspective view also reveals the interior channel 202 created by the adapter. It is this channel 202 that provides a communicable channel between the interior portion of the bag and the exterior of the bag. The perspective view also reveals along the interior wall of the channel a raised rib or bead or projecting ring about the interior of the wall which is utilized for retention purposes.

Figure 9:
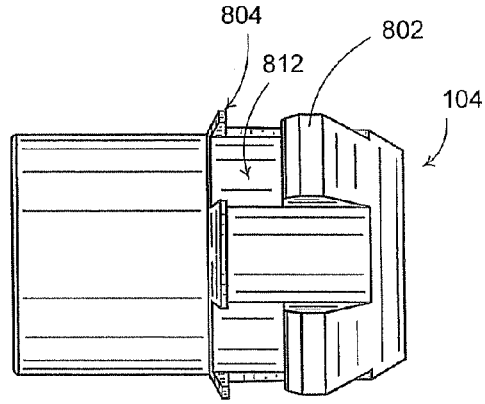
FIG. 9 is a right-side plan view of the adapter.

Referring to FIG. 9, a right-side plan view of the adapter is shown. The side view of the adapter 104 further reveals the valley 812 or recessed area between the rear protrusions 802 and the front protrusions 804. It is along this valley 812 that the bag is bound to the adapter in a substantially permanent manner. The side view further reveals how the front and rear protrusions provide a gripping means for assisting the user in removing the collection bag device from the exhaust conduit of a powered tool and installing it thereto.

Figure 10:
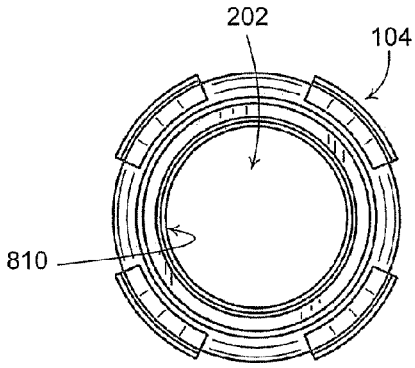
FIG. 10 is a front plan view of the adapter.

Referring to FIG. 10, a front plan view of the adapter is shown. The front view of the adapter 104 reveals the channel 202 of the adapter 104. The front view also reveals the raised rib or bead 810 which extends about the interior perimeter of the channel 202.

Figure 11:
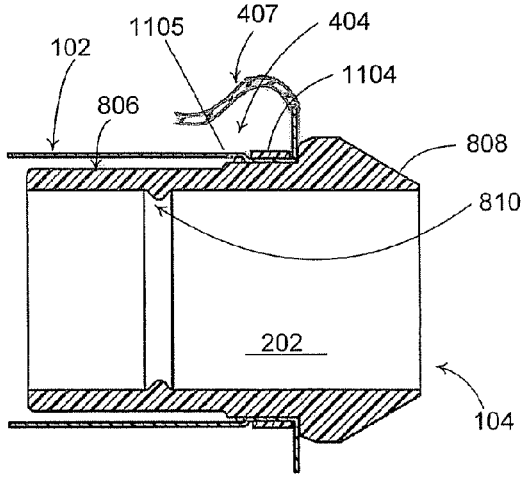
FIG. 11 is a cross sectional view of the adapter also depicting a cross section of the bag's sleeve mounted to the adapter.

Referring to FIG. 11, a cross sectional view of the adapter also depicting a cross section of the bag's sleeve mounted to the adapter is shown. The cross sectional view of the adapter 104 reveals how the collection bag 102 is connected to the adapter 104. The sleeve 407 of the collection bag is shown installed about the exterior of the rear portion 808 of the adapter 104. The sleeve 407 is connected along seam 1105 to the collection bag 102, where a mouth of the sleeve is connected along the inner edges of the debris entry opening of the bag. The rim or mouth of the sleeve 407 is connected along the interior edge of the opening 404 of the collection bag. The adapter 104 thereby creates a communicable channel 202 between the interior portion of the bag and the exterior of the bag. The adapter is substantially permanently affixed to the bag by a band 1104 or clamping device. The band 1104 clamps the sleeve portion 407 of the collection bag 102 and the valley area 812 of the adapter 104. The sleeve is thereby clamped in place in the valley area 812 between the front protruding members 804 and the rear protruding members 802. The member 1104 can be a band or a clamp or other appropriate device that is constructed of steel or other appropriate material that is capable of substantially permanently affixing the bag sleeve to the adapter. The cross section of the adapter also reveals the interior raised rib or bead 810, which is utilized to retain the collection bag device to the exhaust conduit of a powered tool. The adapter preferably has an interior hollow substantially cylindrical channel 202 extending there through end to end where an interior wall of the channel has a protruding bead ring 810. The raised bead ring or rib is press fit about the exterior of an exhaust conduit of a powered tool and is positioned to drop into a recessed ring area formed within the exterior of the exhaust conduit.

Figure 12:
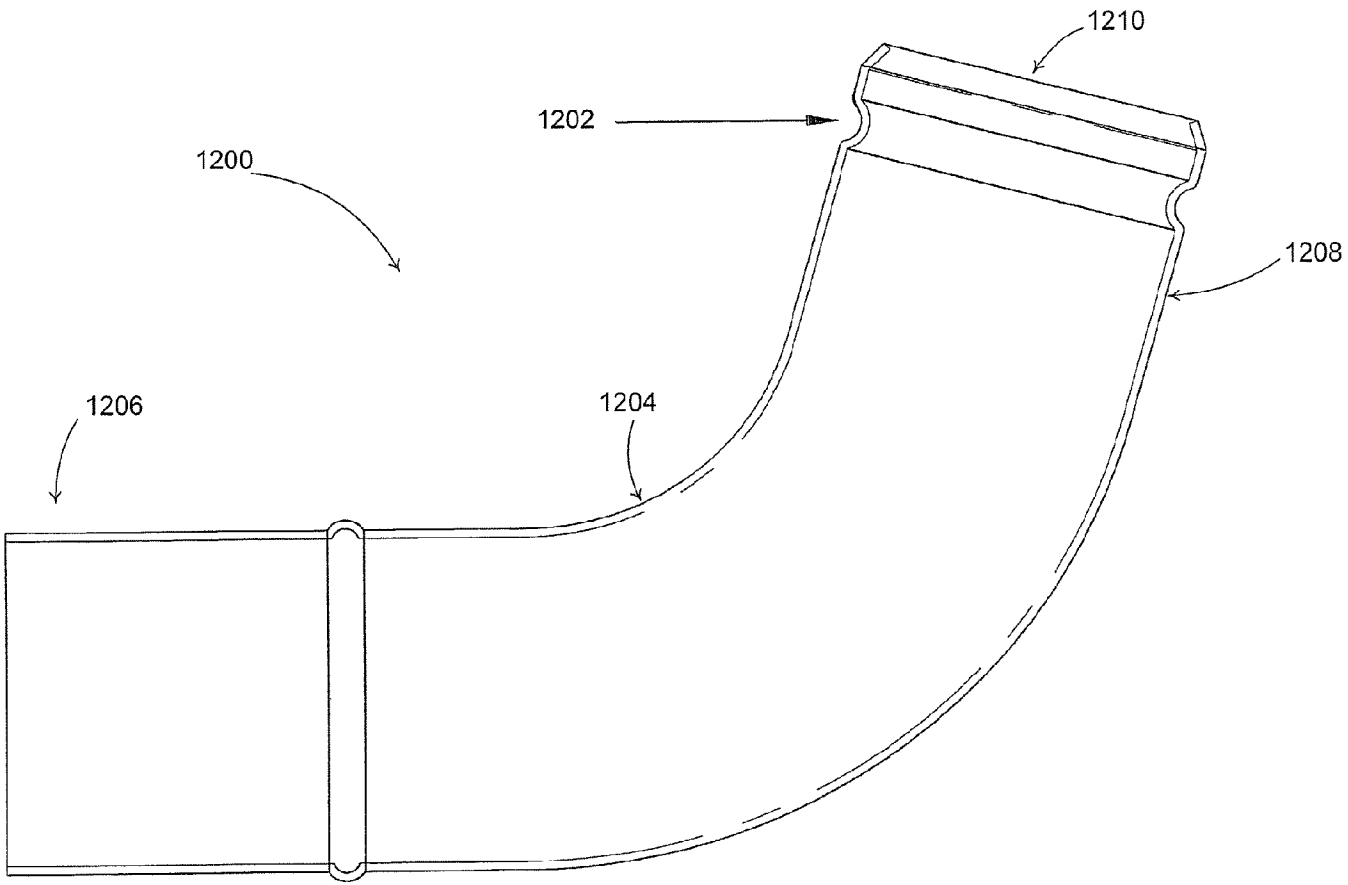
FIG. 12 is a right side plan view of the extension tube.

Referring to FIG. 12, a right side plan view of the extension tube is shown. The right side view of the extension tube shown can be utilized to attach the collection bag device 100 to an exhaust conduit of a powered tool. However, this extension tube device would not necessarily have to be utilized with the present invention. This alternative embodiment is presented for additional ease of use. The extension tube 1200 includes a rear portion 1206 or entry end that mounts to the exhaust conduit of the powered tool and a front portion 1208 or exit end which mounts to the adapter of the collection bag device. The extension tube can also have a bent elbow portion 1204 which is designed to position the collection bag device when installed at an ergonomically desired position. The front portion of the extension tube 1208 comprises a recessed ring portion 1202 formed in the exterior surface of the extension tube. The recessed ring portion 1202 of the extension tube is utilized to receive the bead or raised rib portion of the adapter. The press fit arrangement provides for retention of the collection bag device to the elasticity and resilience of the adapter material. The extension tube 1200 also provides a communicable channel 1210 between the adapter channel and the exhaust conduit of the powered tool. As mentioned above, the extension tube 1200 is only an optional embodiment because the exhaust conduit of the powered tool can have a recessed ring portion similar to that of 1202 for mounting the collection bag device.

Figure 13:
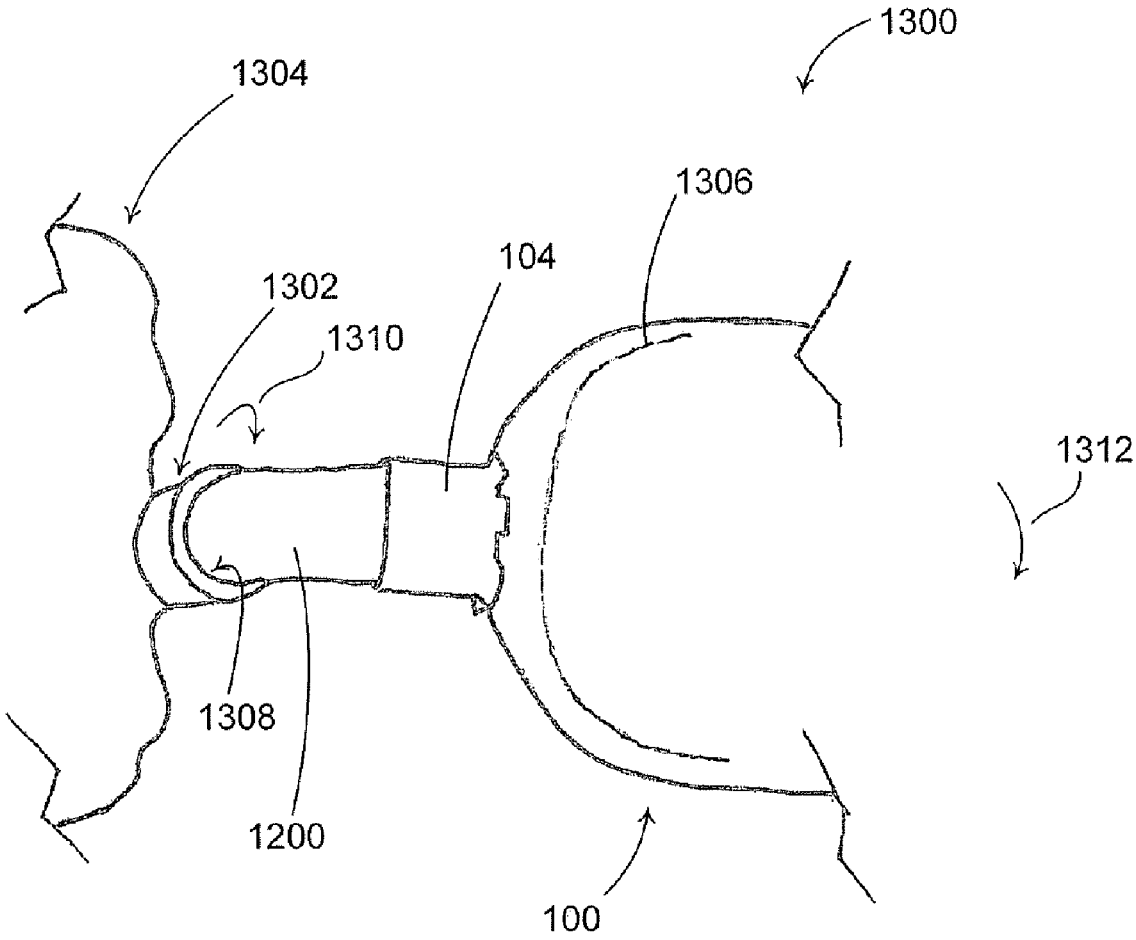
FIG. 13 is a top plan view is representative of the collection device installed on a sander.

Referring to FIG. 13, a top plan view is representative of the collection device installed on a sander is shown. The top view of the collection bag installed from a powered tool 1300 reveals various operational features of the collection bag device. Item 1304 is a representative illustration of the rear portion of a powered tool such as a sander. The powered tool has an exhaust conduit 1302 having an exit opening 1308. The embodiment shown reflects and extension tube 1200 installed in the opening 1308 of the exhaust conduit 1302. Further, the adaptor 104 of the collection bag device 100 is shown mounted on the extension tube 1200. This mounting arrangement provides a communicable channel between the exit of the exhaust conduit through the extension tube and into the interior portion of the collection bag device 100. This configuration can be designed such that the extension tube 1200 can rotate within the opening 1308 as indicated by arrow 1310 thereby allowing the collection bag device 100 to rotate or pivot as indicated by arrow 1312. This allows the user to position the collection bag device for ease of usage by allowing the collection bag device and extension tube to rotate about the cylindrical axis of the exhaust conduit and the extension tube at the point where the extension tube mounts to the exhaust conduit. This top view is also utilized to illustrate a typical seam 1306 between the top panel and adjacent panels of the collection bag. A further view of this seam is shown in FIG. 14 and a detail of the safety-type stitching that can be utilized for a reinforced seam is detailed in FIG. 15.

Figure 14:
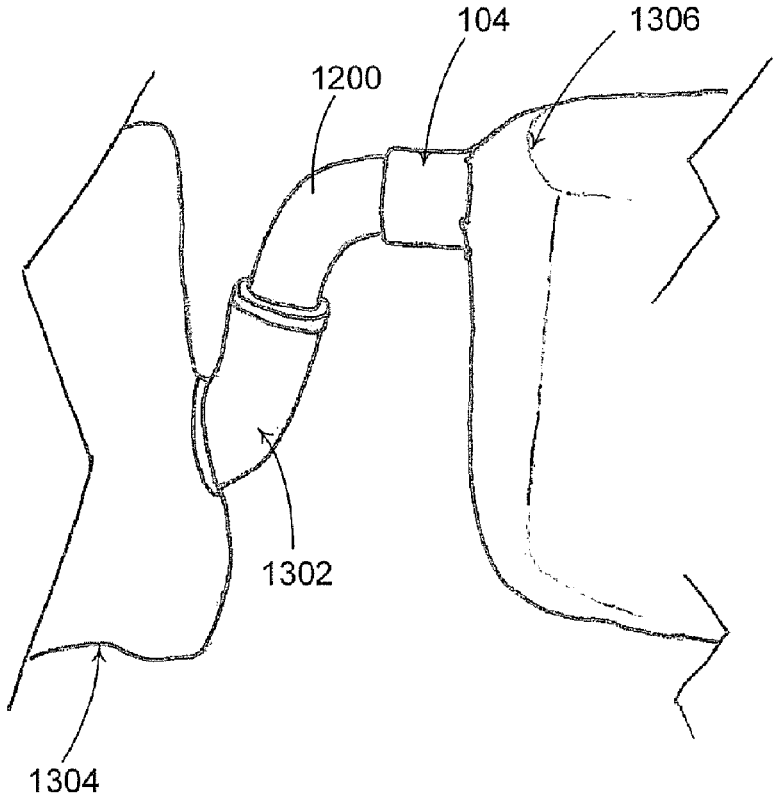
FIG. 14 is a right side plan view is representative of the collection device installed.

Referring to FIG. 14, a right side plan view is representative of the collection device installed is shown. This side view is a further illustration of the installation shown in FIG. 13. An illustration of the rear portion of a sander 1304 is shown having an exhaust conduit 1302 communicably connected to the extension tube 1200 and further communicably connected to the adapter 104. A typical seam 1306 is further revealed in this view and is further detailed in FIG. 15.

Referring to FIG. 15, a representation of a safety stitch for seams of a collection bag is shown. This is a figure that illustrates one embodiment of safety stitching that can be utilized to assure that the seams are substantially reinforced for durability and to prevent debris from escaping from the interior portion of the bag into the atmosphere. The safety stitching 1500 shown reveals a primary stitch 1505 and a secondary safety stitch 1506 which includes an overlap stitch 1507 which overlaps in a crossing manner the connecting pieces of cloth edges 1508.

The various collection bag embodiments and examples shown above illustrate a novel collection bag with integrated adapter for attaching to a powered tool or appliance such as a sander. A user of the present invention may choose any of the above collection bag embodiment, or an equivalent thereof, depending upon the desired application. In this regard, it is recognized that various forms of the subject collection bag with self sealing retention system could be utilized without departing from the spirit and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. A debris collection device with a self sealing retention system comprising:

a.) a bag having a reclosable zippered opening constructed such that when the zippered opening is zipped closed the bag defines a substantially closed interior volume whereby only a small debris entry opening remains;

b.) a substantially tubular resilient elastomeric adapter having an interior hollow substantially cylindrical channel extending therethrough end to end and where an exterior surface of said adapter has forward and aft protrusions formed therein and proximately spaced apart from each other forward to aft along a length of said adapter defining a valley between said forward and aft protrusions; and c.) where the adapter is inserted lengthwise through the debris entry opening and the inner edges of the debris entry opening are fixedly attached to the adapter in the valley of the adapter such that the interior channel of the adapter communicably links the interior volume of the bag with an exterior area surrounding the bag.

2. The collection device of claim 1 where the bag is constructed of cloth panels sewn together by primary stitching, safety stitching and overlap stitching.

3. The collection device of claim 1 where the debris entry opening is fixedly attached to the adapter in the valley by a steel band tightly cinching the bag about the adapter.

4. A debris collection device with a self-sealing retention system comprising:

a.) a bag having a reclosable zippered opening constructed such that when the zippered opening is zipped closed the bag defines a substantially closed interior volume whereby only a small debris entry opening remains;

b.) a sleeve open on opposing ends and a mouth of one end secured to and about the inner edges of the debris entry opening;

c.) a substantially tubular resilient elastomeric adapter having an interior hollow substantially cylindrical channel extending therethrough end to end where an interior wail of the channel has a protruding bead ring and where an exterior surface of said adapter has forward and aft protrusions formed therein and proximately spaced apart from each other forward to aft along a length of said adapter defining a valley between said forward and aft protrusions; and d.) where the adapter is inserted lengthwise through the debris entry opening and further through the interior of the sleeve and the sleeve is fixedly attached to the adapter in the valley of the adapter such that the interior channel of the adapter communicably links the interior volume of the bag with an exterior area surrounding the bag.

5. The collection device of claim 4 where the bag is constructed of cloth panels sewn together by primary stitching, safety stitching and overlap stitching.

6. The collection device of claim 4 where the sleeve is fixedly attached to the adapter in the valley by a steel band tightly cinching the sleeve of the bag about the adapter.

7. A debris collection device with a self sealing retention system comprising:

a.) a bag having a reclosable zippered opening constructed such that when the zippered opening is zipped closed the bag defines a substantially closed interior volume whereby only a small debris entry opening remains;

b.) a sleeve open on opposing ends and a mouth of one end secured to and about the inner edges of the debris entry opening;

c.) a substantially tubular resilient elastomeric adapter having an interior hollow substantially cylindrical channel extending therethrough end to end where an interior wall of the channel has a protruding bead ring and where an exterior surface of said adapter has forward and aft protrusions formed therein and proximately spaced apart from each other forward to aft along a length of said adapter defining a valley between said forward and aft protrusions;

d.) where the adapter is inserted lengthwise through the debris entry opening and further through the interior of the sleeve and the sleeve is fixedly attached to the adapter in the valley of the adapter such that the interior channel of the adapter communicably links the interior volume with an exterior area surrounding the bag; and e.) an elongated extension tube having a recessed ring area formed in an exterior surface on an exit end of the extension tube where the exit end of the extension tube is press fit lengthwise through the interior channel of the adapter a distance sufficient to mate the recessed ring area and the protruding bead ring.

8. The collection device of claim 7, where the bag is constructed of cloth panels sewn together by primary stitching, safety stitching and overlap stitching.

9. The collection device of claim 7, where the sleeve is fixedly attached to the adapter in the valley by a steel band tightly cinching the sleeve of the bag about the adapter.

10. The collection device of claim 7, where entry end of the extension tube is sized and constructed to communicably link to and mount on the exhaust conduit of a powered tool and is constructed to allow rotation about the cylindrical axis of the exhaust conduit and the extension tube.

* * * * *

UNITED STATES PATENT AND TRADEMARK OFFICE

CERTIFICATE OF CORRECTION

PATENT NO. : 7,404,835 B2
APPLICATION NO. : 10/905523
DATED : July 29, 2008
INVENTOR(S) : Michael G. Kramer It is certified that error appears in the above-identified patent and that said Letters Patent is hereby corrected as shown below:

Claim 4, Col. 8, line 18, delete “wail” and replace with -- wall --

Signed and Sealed this

Sixteenth Day of September, 2008

JON W. DUDAS
*Director of the United States Patent and Trademark Office*